US012031385B2

(12) United States Patent
Rennkamp

(10) Patent No.: US 12,031,385 B2
(45) Date of Patent: Jul. 9, 2024

(54) DRILL HEAD AND METHOD FOR PRODUCING A VERTICAL BOREHOLE IN THE GROUND

(71) Applicant: HERRENKNECHT AG, Schwanau (DE)

(72) Inventor: Patrick Rennkamp, Lahr (DE)

(73) Assignee: Herrenknecht AG, Schwanau (DE)

( * ) Notice: Subject to any disclaimer, the term of this patent is extended or adjusted under 35 U.S.C. 154(b) by 0 days.

(21) Appl. No.: 17/628,852

(22) PCT Filed: Jul. 21, 2020

(86) PCT No.: PCT/EP2020/070579
§ 371 (c)(1),
(2) Date: Sep. 28, 2022

(87) PCT Pub. No.: WO2021/013846
PCT Pub. Date: Jan. 28, 2021

(65) Prior Publication Data

US 2023/0147209 A1 May 11, 2023

(51) Int. Cl.

| | |
|---|---|
| ***E21B 21/12*** | (2006.01) |
| ***E21B 10/60*** | (2006.01) |
| ***E21D 1/06*** | (2006.01) |
| ***E21D 9/11*** | (2006.01) |

(52) U.S. Cl.
CPC ..... *E21B 10/602* (2013.01); *E21B 21/12* (2013.01); *E21D 9/11* (2013.01); *E21D 1/06* (2013.01)

(58) Field of Classification Search
CPC . E21B 21/00; E21B 21/16; E21D 1/06; E21D 9/11
See application file for complete search history.

(56) References Cited

U.S. PATENT DOCUMENTS

| | | | | |
|---|---|---|---|---|
| 3,360,061 A | | 12/1967 | Canalizo | |
| 3,384,191 A | | 5/1968 | Schumacher et al. | |
| 4,105,083 A | * | 8/1978 | Allen | E21B 10/18 175/313 |
| 4,195,700 A | | 4/1980 | Worder | |
| 4,200,160 A | | 4/1980 | Newcomb | |

(Continued)

FOREIGN PATENT DOCUMENTS

| | | |
|---|---|---|
| DE | 2829834 A1 | 1/1979 |
| DE | 1962591 C1 | 4/1984 |

(Continued)

*Primary Examiner* — Robert E Fuller
(74) *Attorney, Agent, or Firm* — Mark Rodgers

(57) ABSTRACT

A drill head and a method having a body connected to a rotary drive of a drilling device, for loosening the ground at a face of the borehole, having a discharge device for discharging the loosened ground to a suction unit for suctioning a conveying medium, wherein the discharge device has at least one opening in the region of the drilling tools The at least one opening is connected to a suction box which has, at an end opposite the opening a connector opening for connecting to a conveying line, that acceleration exerted on the loosened ground in the region of the suction box moves loosened ground through the opening into the suction box wherein the loosened ground acquired by the conveying medium in the opening and/or in the suction box and is discharged.

19 Claims, 16 Drawing Sheets

(56) References Cited

U.S. PATENT DOCUMENTS

| | | | |
|---|---|---|---|
| 4,296,824 | A | 10/1981 | Kennington |
| 4,534,426 | A | 8/1985 | Hooper |
| 2013/0008723 | A1 | 1/2013 | Hoelting et al. |
| 2013/0269220 | A1 | 10/2013 | Matthias et al. |

FOREIGN PATENT DOCUMENTS

| | | | | | |
|---|---|---|---|---|---|
| DE | 69013666 | T2 | | 3/1995 | |
| EP | 3252263 | A1 | * | 12/2017 | ..... E21B 10/08 |
| KR | 101762879 | B1 | | 7/2017 | |
| WO | 2016142910 | A1 | | 9/2016 | |
| WO | 2018114230 | A1 | | 6/2018 | |

* cited by examiner

DRILL HEAD AND METHOD FOR PRODUCING A VERTICAL BOREHOLE IN THE GROUND

The invention relates to a drill head and to a method for producing a substantially vertical borehole in the ground, in particular for producing a shaft, having a body which is able to be connected to a rotary drive of a drilling device, having drilling tools which for loosening the ground at a face of the borehole are disposed on the body, having a discharge device which for discharging the loosened ground on the face is able to be connected to a suction unit for suctioning a conveying medium by way of a conveying line, wherein the discharge device has an opening region which is disposed on the body and has at least one opening in the region of the drilling tools at the face.

Such a drill head is known from, for example, U.S. Pat. No. 4,646,853 A, EP 2597249 B1, U.S. Pat. Nos. 3,384,191 A, 4,195,700 A and 4,200,160 A.

U.S. Pat. No. 4,646,853 A discloses a device and a method for sinking a shaft. A cutting wheel which is rotatable about a vertical axis is provided for loosening the ground. Mechanical conveying by buckets is provided for discharging the loosened ground.

EP 2597249 B1 shows a drilling device for establishing vertical boreholes in the soil, having a drill head which rotates on a face. A suction system is provided which has an opening which is disposed externally on the end of the drill head that faces the face and rotates conjointly with the drill head. Loosened ground is discharged from the borehole here.

U.S. Pat. No. 3,384,191 A shows a drill head which has roller chisels and likewise has a suction system for discharging the loosened ground. Provided to this end is a guide plate which is disposed in the region of the opening of the suction system and collects the loosened ground during the rotation of the drill head and feeds said loosened ground to the opening. An oblique duct which opens into a centrically disposed discharge line is disposed behind the opening.

U.S. Pat. No. 4,195,700 A likewise discloses a drill head which has roller chisels and which has a radial opening, a discharge line being provided at the inner end of said drill head. The opening is embodied as a slot behind which a conically shaped tube that widens toward the discharge line is provided.

U.S. Pat. No. 4,200,160 A discloses a drill head which has a suction system for discharging the loosened ground. The suction system provides a slot-shaped radial opening which opens into a cylindrical space. A duct which leads into the waste water line emanates from said cylindrical space.

It is an object of the invention to simplify the suction system in the abovementioned drill heads and to simultaneously improve said suction systems in terms of their performance.

In terms of the drill head, the object is achieved in that the at least one opening of the opening region is connected to a suction box which as a component part of the discharge device has, at an end opposite the opening, a connector opening for connecting to the conveying line, in that at least one element which exerts an acceleration on the loosened ground in the region of the suction box is provided, by way of which acceleration the ground loosened by the drilling tools is able to be moved into the opening region and/or through the opening into the suction box, wherein the loosened ground is acquired by the conveying medium in the opening region, preferably in the opening and/or in the suction box, and is able to be discharged by way of the conveying line by the suction unit.

As a result thereof, it becomes possible in a surprisingly simple manner to discharge the loosened ground, in particular in the case of comparatively heavy, inertial component parts which are not readily suctionable, and at the same time to significantly increase the suction output.

A further teaching of the invention provides that the at least one element is at least one nozzle which is provided so as to be directed into the opening region and dispenses at least one jet of a transport medium so as to effect the acceleration.

A further teaching of the invention provides that at least one deflection region, in which the flow direction of the loosened ground is able to be deflected, is provided behind the opening, preferably prior to entering the suction box. As a result thereof, the material to be discharged can be fed to the discharge and subsequently be discharged in a particularly simple manner.

A further teaching of the invention provides that at least one tool, preferably in the form of a toothed bar, for loosening the ground and/or for picking up loosened ground, is provided in the opening region. As a result thereof, loosening/picking-up of rock/ground at the face can be performed directly in the opening region. The material thus loosened/picked up can be fed to the suction unit in a particularly positive manner.

It is furthermore advantageous that the at least one tool is able to be moved for changing the spacing of the tool from the face, preferably by way of at least one hydraulic cylinder, and/or that the at least one tool is pivotable in relation to the opening region, preferably by way of at least one hydraulic cylinder.

A further teaching of the invention provides that the spacing of the opening region from the face is adjustable. It is advantageous here that the adjustment of the spacing takes place by vertically moving the suction box and/or by pivoting the suction box about a pivot point, wherein a drive, preferably a hydraulic cylinder or a spring mechanism, is provided for moving or pivoting. As a result thereof, the quantity of the suctioned material is thus able to be influenced directly in a simple manner.

A further teaching of the invention provides that the opening region is provided with a cleaning tool, preferably at least one movable element and/or at least one nozzle for dispensing a medium, for example a gas (air) or a liquid (water, bentonite purge). As a result thereof, obstructions in the opening region can either be eliminated or prevented.

A further teaching of the invention provides that at least one purging nozzle is provided by way of which ground loosened by at least one drilling tool is able to be transported into a region on the face that is traveled across by the suction box when drilling with the drill head. As a result thereof, the transportation of material toward the suction box is improved in a simple manner.

A further teaching of the invention provides that the suction box is provided so as to be replaceable in the drill head. As a result thereof, the drill head can be readily adapted to different geological conditions. Furthermore, a reversal of the rotating direction is also possible.

A further teaching of the invention provides that a classifying element is provided in the opening region. This can be, for example, a mesh, separators which divide the opening region into a plurality of openings, or else a plurality of openings. As a result thereof, it becomes possible to achieve in a simple manner a limitation in terms of the grain size of the suctioned material.

A further teaching of the invention provides that the suction box is disposed so as to be substantially horizontal. As a result thereof, the transportation of material in the suction box and the pick-up of material are positively influenced.

A further teaching of the invention provides that the opening region, when viewed from the center, extends in a substantially radially outward manner. It is advantageous here for the opening to be embodied in an elongate manner, or in the manner of a slot, respectively. A further teaching of the invention provides that the available cross section of the opening, when viewed in a radially outward manner, varies along the opening region, preferably increases along the latter. As a result thereof, the pick-up of material, the location of the material pick-up, as well as the picked up quantity can be influenced in a simple manner.

It is furthermore advantageous that the connector opening of the suction box, in terms of the opening region, is disposed so as to be offset, preferably in an outward manner, in relation to a perpendicular bisector of the opening region. As a result thereof, the suction box is of an asymmetrical construction. The suction intensity, or the flow profile, respectively, in the suction box or in the opening region can be influenced in a simple manner so that the suctioned quantity of material is able to be influenced. For example, the flow in that region of the suction box that, when viewed radially, is on the outside can be increased by way of an outward displacement so as to be better able to suction the larger quantity of material arising there.

A further teaching of the invention provides that the connector opening of the suction box, in terms of the opening region, is disposed so as to be pivoted in relation to a perpendicular bisector of the opening region. The suction intensity, or the flow profile, respectively, in the suction box or in the opening region can be influenced in a simple manner so that the suctioned quantity of material is able to be influenced. For example, the flow in that region of the suction box that, when viewed radially, is on the outside can be increased by way of an inward tilting of the connector opening, so as to be better able to suction the larger quantity of material arising there.

A further teaching of the invention provides that the suction box has at least one nozzle in the interior space. As a result thereof, the movement of the loosened ground/rock for acquisition by the conveying medium can be improved in a simple manner.

A further teaching of the invention provides that the conveying medium and/or the transport medium is a liquid or gaseous medium, preferably water, a bentonite suspension, or air. A particularly preferred combination here is that the conveying medium is air and the transport medium is air or a liquid, preferably water. This is applied when the drill head is not flooded, is not to be flooded, or cannot be flooded, and liquid-based conveying is thus precluded. It has been surprisingly demonstrated that the loosened ground/the loosened rock is readily able to be transported/activated by the dispensed jet and is able to be advantageously fed to and discharged by the conveying flow of air.

A further teaching of the invention provides that the at least one element is at least one driven rotary element having at least one impact element disposed thereon, wherein the at least one impact element, by way of a rotating movement, effects the acceleration of the loosened ground by contacting the latter.

It is advantageous here that the impact element is movable on an impact circle which is provided so as to be concentric about the rotary element.

A further teaching of the invention provides that the at least one impact element, preferably by way of a joint, is movably disposed on the at least one rotary element.

A further teaching of the invention provides that the at least one impact element is a hammer, a blade, a cable, a chain, a brush element, or a chisel.

A further teaching of the invention provides that the rotation of the at least one rotary element is able to be controlled in terms of the rotating speed.

A further teaching of the invention provides that the at least one impact element causes a comminution of the loosened ground.

A further teaching of the invention provides that the suction box is provided so as to be horizontal, inclined and/or vertical.

The object according to the invention is furthermore achieved by a method for producing a substantially vertical borehole in the ground, in particular for producing a shaft, by way of a drill head, in particular by way of a previously described drill head, wherein the drill head is connected to a rotary drive of a drill device, wherein the drill head has a body on which drilling tools are disposed by way of which during drilling the ground at a face of the borehole is loosened and comminuted to a dischargeable size, wherein the loosened and comminuted ground is transported from the face by a discharge device which is connected to a suction unit for suctioning a conveying medium by way of a conveying line, wherein the discharge device has a suction box having an opening region having at least one opening in the region of the drilling tools at the face, said method comprising the following steps:

introducing an acceleration into loosened ground situated in the region of the opening region, and acquiring the loosened ground by a conveying medium and discharging said loosened ground by way of the conveying line by the suction unit.

A further teaching of the invention provides that the loosened ground is moved through the opening into the suction box as a result of the introduced acceleration.

A further teaching of the invention provides that the acquiring takes place in the suction box and/or in the opening region, preferably in front of the opening.

A further teaching of the invention provides that the accelerating takes place by dispensing a jet of a transport medium from a nozzle which is directed into the opening region of the suction box as a component part of the discharge device.

A further teaching of the invention provides that the moving of the loosened ground takes place by the transport medium.

Alternatively or additionally, it is furthermore provided that the accelerating takes place by at least one driven rotary element having at least one impact element disposed thereon, wherein the at least one impact element, by way of a rotating movement, effects the acceleration of the loosened ground by contacting the latter.

A further teaching of the invention provides that the moving of the loosened ground takes place by the impact element.

As described above, it is advantageous here that the conveying medium and/or the transport medium is a liquid or gaseous medium, preferably water, a bentonite suspension, or air.

The terms ground and rock are used synonymously in this application. The same applies in an analogous manner to loosened ground and debris.

The invention will be explained in more detail hereunder by means of exemplary embodiments in conjunction with a drawing. In the drawing:

Figure 1:
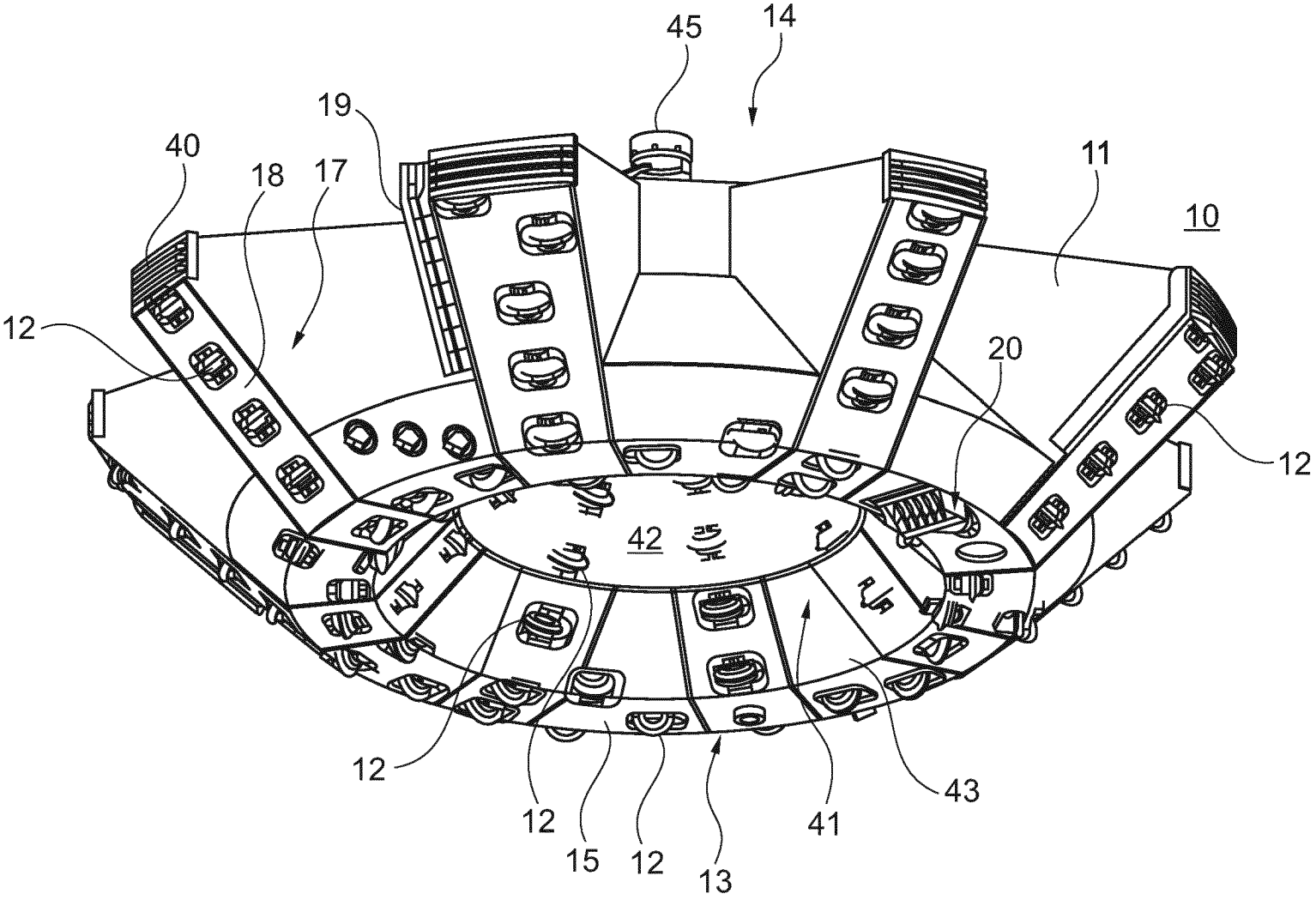
FIG. 1 shows a three-dimensional view of the lower side of the drill head of the first embodiment according to the invention.

FIG. 1 in a three-dimensional illustration shows a drill head 10 according to the invention in a first embodiment. The drill head 10 has a body 11, drilling tools 12 being disposed on the lower side 13 thereof. The drill head 10, on the upper side 14 thereof, has a connector (not illustrated) for a drive (not illustrated) of a drill device (not illustrated). The drive not illustrated here is provided directly in the drill device, for example in a shaft drilling machine, for example. Further variants of drives, drill devices and assemblies in a borehole/pole/casing are likewise possible.

The lower side 13 here has a planar annular portion 15 (other shapes are possible), drilling tools 12 being provided on the lower side 16 thereof.

Proceeding from the annular portion, arms, here eight arms 17 for example, which each have a flank 18 which here in an exemplary manner is planar, extend outward. Clearing tools 19 and consumable elements 40 can be provided on the flanks. Alternatively, the flanks 18 can also be embodied so as to encircle the entire area.

A depression 41 which, for example, has a planar area 42 and flanks 43 on which drilling tools 12 are likewise provided is provided in the center of the lower side 13, for example.

Figure 8:
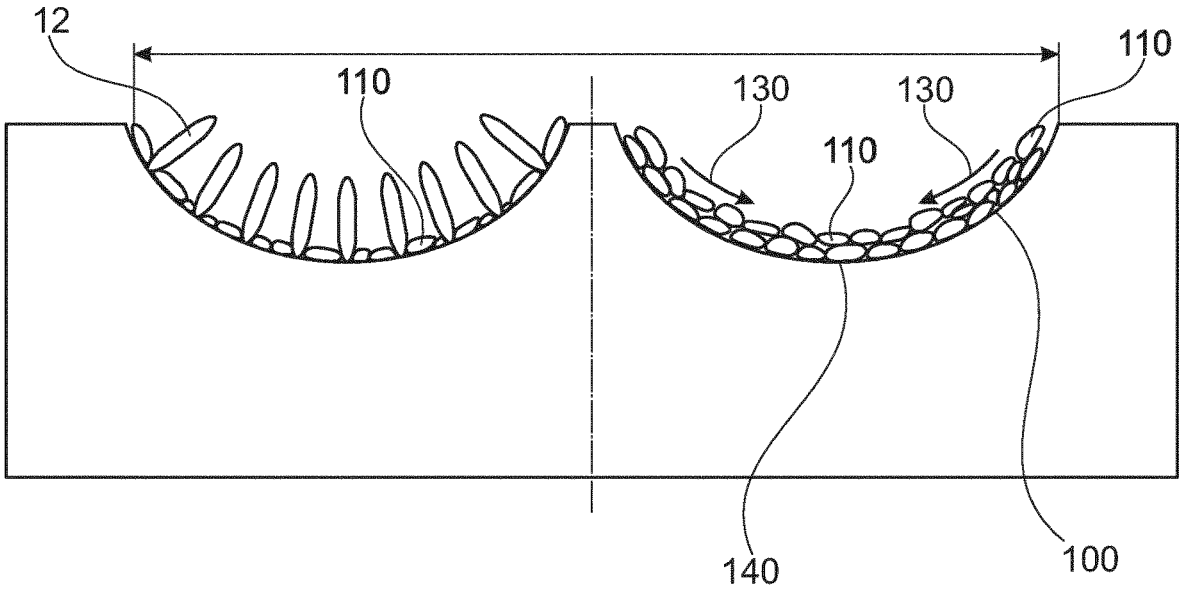
FIG. 8 shows a first diagram pertaining to the discharge according to the invention in conjunction with a drill head as per FIG. 1.
Figure 9:
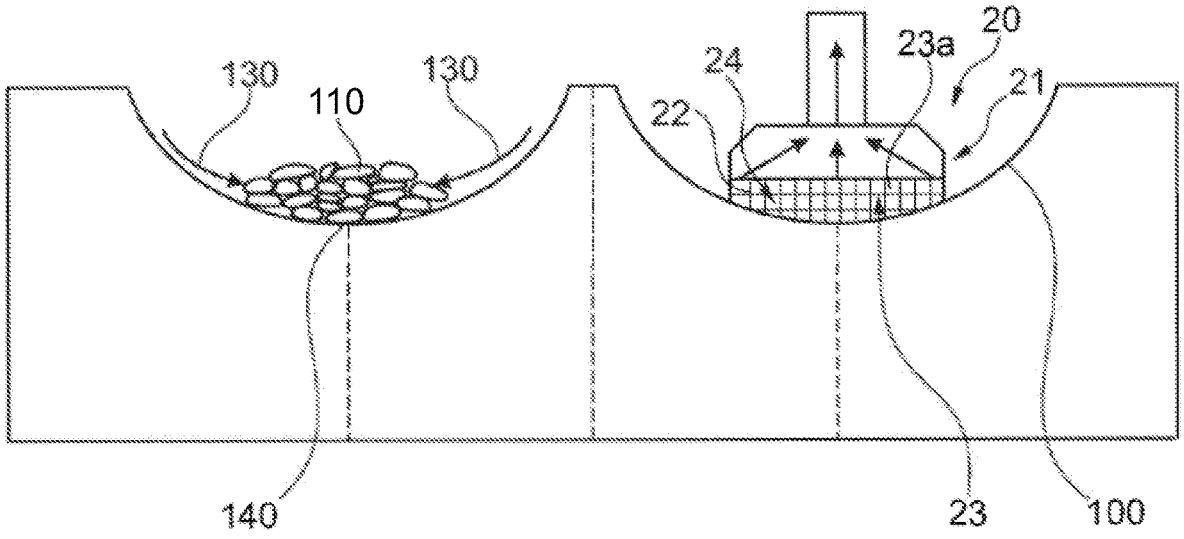
FIG. 9 shows a second diagram pertaining to the discharge according to the invention in conjunction with a drill head as per FIG. 1.
Figure 16:
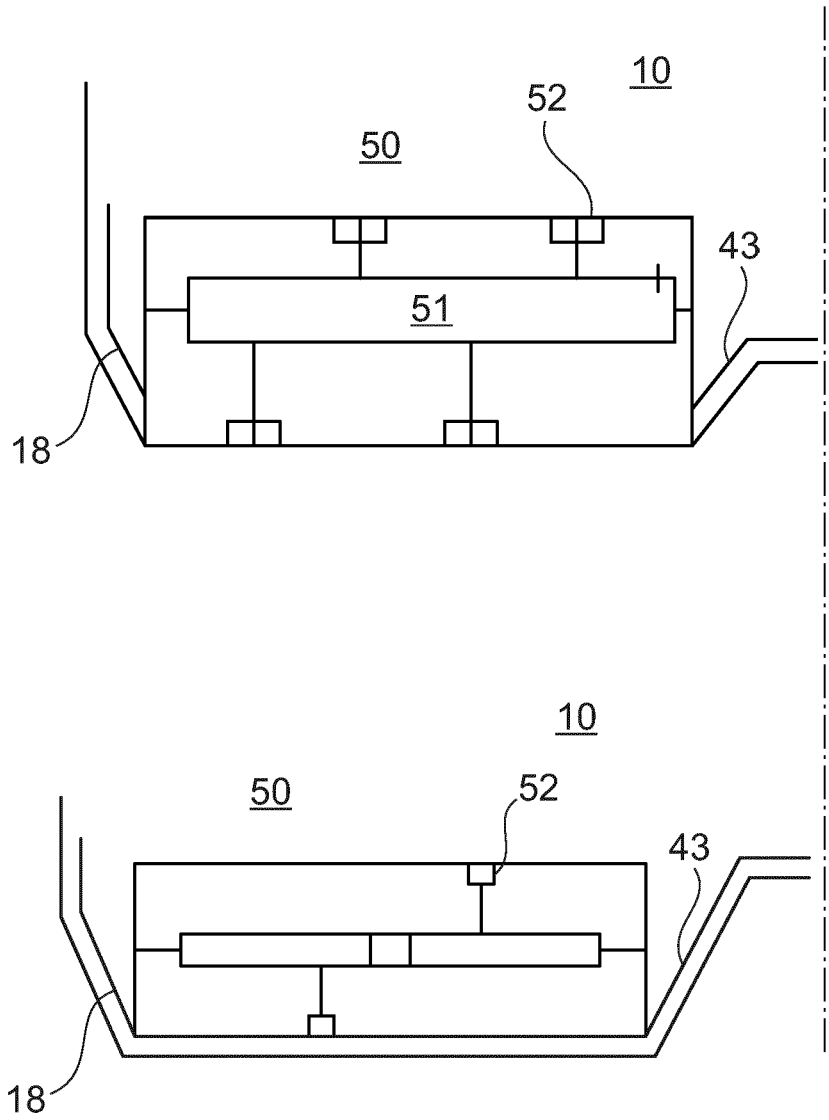
FIG. 16 shows drill head profiles as an alternative to FIG. 14.

The shape of the drill head described here is also referred to as a W drill head. The associated drill profile is illustrated in FIGS. 8 and 9. The width of the planar annular portion 15 as well as the angles of the inner and outer flanks 43, 18, as well as the size of the inner area 42, here are variable and depend on the extraction conditions, as is also illustrated in FIG. 16.

The drilling tools 12 can be, for example, chisel disks 12*a*, peeling chisels 12*b*, or roller chisels 12*c*, or other alternatives. The selection of the drilling tools 12 takes place as a function of the ground/rock to be loosened in order for the borehole to be established.

The connector 45 of the conveying line 31 is illustrated on the upper side 14 of said drill head 10 in FIG. 1.

Furthermore, the body 11 on the lower side 13 of the W drill head 10 thereof has a suction box 20 on the annular portion 15.

Figure 4:
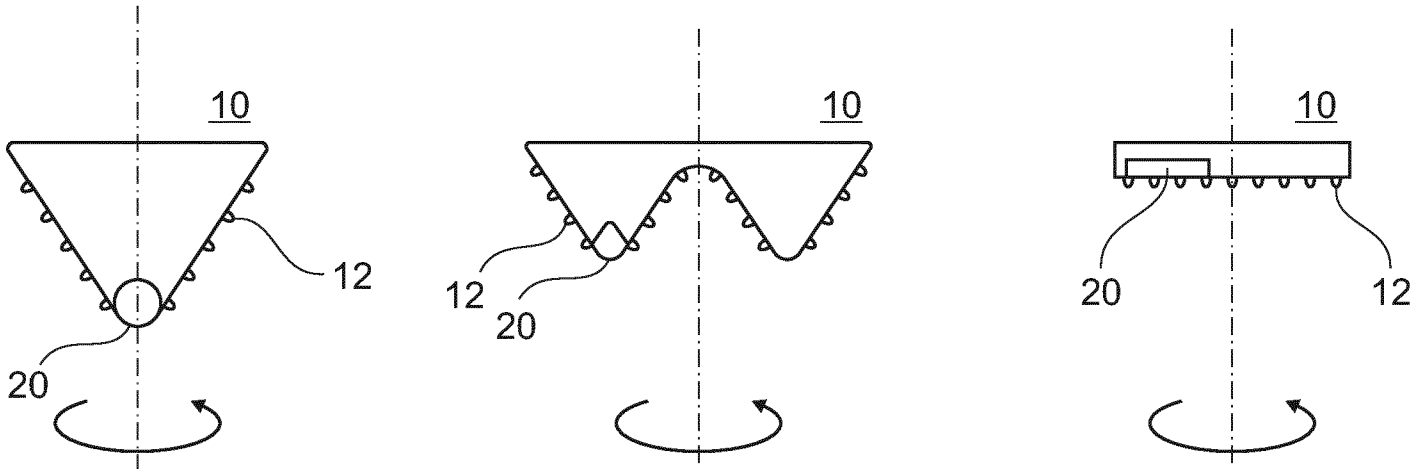
FIG. 4 shows a schematic illustration of alternative shapes of drill heads according to the invention.

Alternative assemblies of the suction box 20 are shown in FIG. 4. In the case of a conical or V-shaped drill head, for example, the suction box 20 according to the invention sits in the maximum penetration of the borehole (on the left in FIG. 4) or extends and is radially provided in a drill head of flat embodiment (on the fight in FIG. 4). A W drill head is illustrated in the center of FIG. 4. Apart from horizontal suction boxes as shown in FIG. 4, for example, embodiments are also possible in which the suction box 20 is inclined or vertical and the opening 23 thereof is directed downward toward the face 100, for example.

Figure 2:
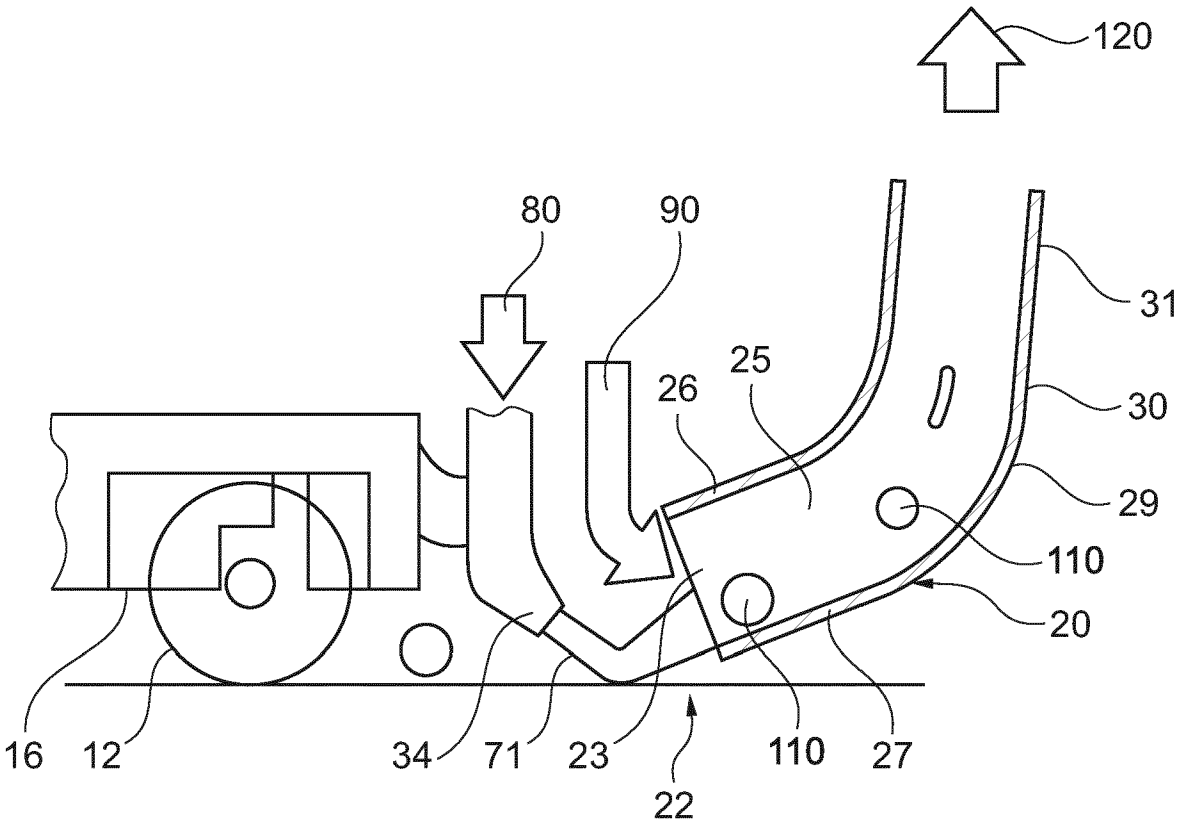
FIG. 2 shows a schematic illustration of a first embodiment of the invention as a fragment of FIG. 1.

The suction box 20 in a first embodiment, as is shown in FIG. 2 for example, on the front side 21 thereof has an opening region 22 which has at least one opening 23. The opening 23 of the first embodiment of the suction box 20 has a classifying element 24 which subdivides the opening 23 into opening portions 23*a*. The grain size of the loosened ground/rock that can enter the interior space 25 of the suction box 20 is determined by the classifying element 24.

The interior space 25 is formed by a lid 26 as the upper side and a base 27 as the lower side, said lid 26 and said base 27 as one embodiment here being embodied in a planar manner. Other shapes of lids and bases are likewise possible. The suction box 20 furthermore has lateral walls 28, the latter here extending from the front side 21 along the shape of the lid and of the base.

The shape of the interior space 25 of the suction box 20 is formed as a result of the shape of the lid 26, of the base 27 and of the lateral walls 28. A box-type construction can be present here. Alternatively, when the width of the interior space 25 decreases, for example as a result of the curved shape of the lateral walls 28, a funnel can be present, as a result of which the flow velocity of the suctioned mixture of loosened ground/rock and carrier medium increases as the width decreases.

On the rear side of the interior space 25, an opening 29 is provided on which a connector 30 for a conveying line 31 is provided which during the drilling operation is connected to a suction unit/pump (not illustrated) so as to perform the discharge of the loosened ground/rock, or of the mixture composed of the conveying medium and the loosened ground/rock.

Additionally, and not illustrated here, the height of the interior space 25 of the suction box 20, proceeding from the front side 21 toward the opening 29 on the rear side of the suction box 20, can also be varied, in particular enlarged, so as to counteract blockages of the interior space 25 by loosened ground/rock.

Furthermore, it is likewise possible for the suction box 20, here illustrated as symmetrical, to be embodied asymmetrically in that the opening 29 is disposed so as to be laterally offset, for example (not illustrated). It can be particularly expedient here, for example in a drill head of a flat embodiment, for the extent of the opening region 22 to be embodied so as to be longer for the opening 29 to be disposed so as to be offset toward the outer circumference of the body 11 so as to increase in a targeted manner the flow velocity in those regions in which more ground/rock is loosened in the rotation of the drill head and enters the interior space 25 of the suction box 20 through the opening 23.

The same is also possible in that the connector 30 of the conveying line 31 (not illustrated) opens into the interior space 25 so as to be inclined into the latter.

The opening region 22, in the region of the opening 23 extending along the front side 21, can have ground loosening tools and/or ground pick-up tools 33, for example peeling blades or clearing blades. By providing such tools, it is possible for ground/rock in the region of the front side 21 of the suction box 20 to be loosened and/or picked up in a targeted manner and to be supplied to the opening 23 of the suction box 20.

Additionally or alternatively, baffles (not illustrated) which feed loosened material to the opening region 22 can also be provided on the lower side 13 of the drill head 10. The feeding can be supported by nozzles such as, for example, purging nozzles 32.

Figure 3:
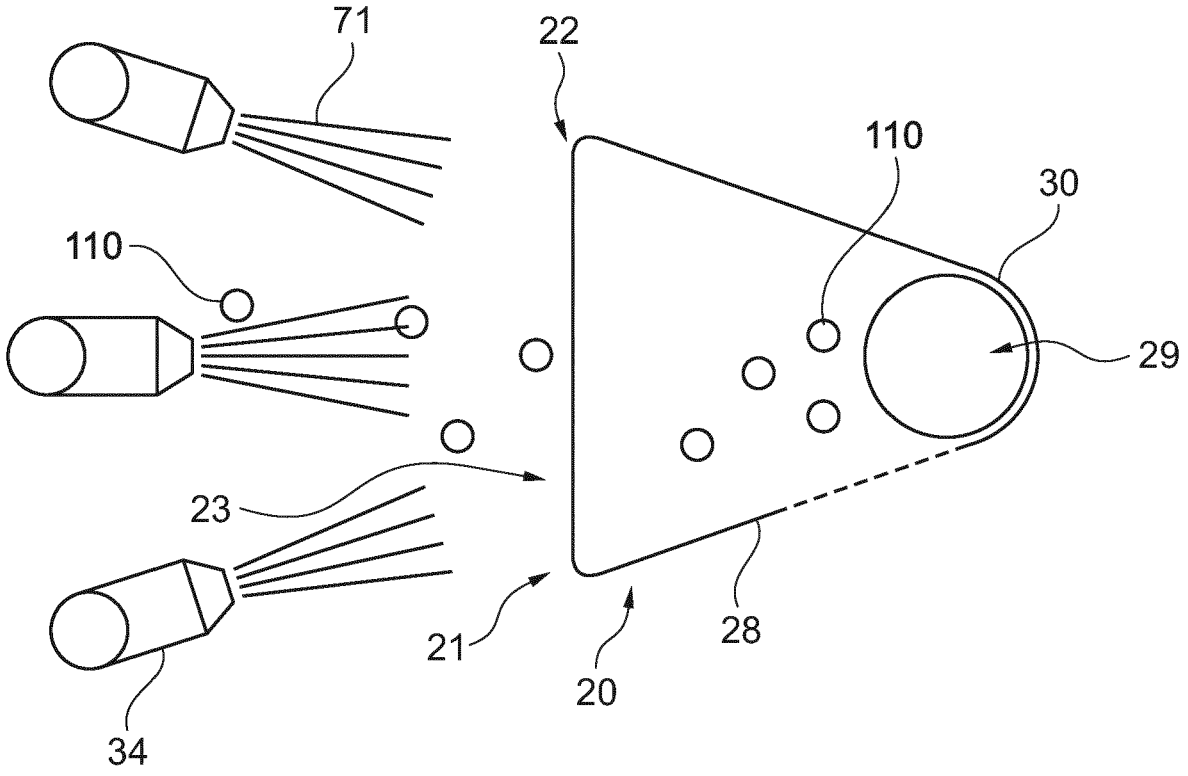
FIG. 3 shows a schematic, partially sectional plan view of FIG. 2.

FIG. 2 and FIG. 3 show a fragment of the drill head 10 according to the invention, having a suction box 20 having an opening 23 and nozzles 34 directed on the latter for dispensing a transport medium 80, preferably air or a liquid such as, for example, water or a bentonite purge. The conveying medium 90 is suctioned through the conveying line 31 which by way of the opening 29 and the connector 30 is connected to the suction box 20. Loosened ground 110 is accelerated by the transport medium jet 71 and transported through the opening 23. In the latter, the loosened ground 110 is acquired by the conveying medium 90. Loosened ground 110, the conveying medium 90 and the transport medium 80 here are mixed so as to form a conveying flow 120 which is then discharged by way of the conveying line. Additionally or alternatively, the transport medium jet 8471, as a result of the introduction of acceleration, causes swirling or loosening of the loosened ground 110 from the face 100 in the opening region 22, respectively, such that the swirling loosened ground is already acquired there by the conveying medium 90 and conjointly with the conveying medium is discharged as a conveying flow 120.

Figure 5:
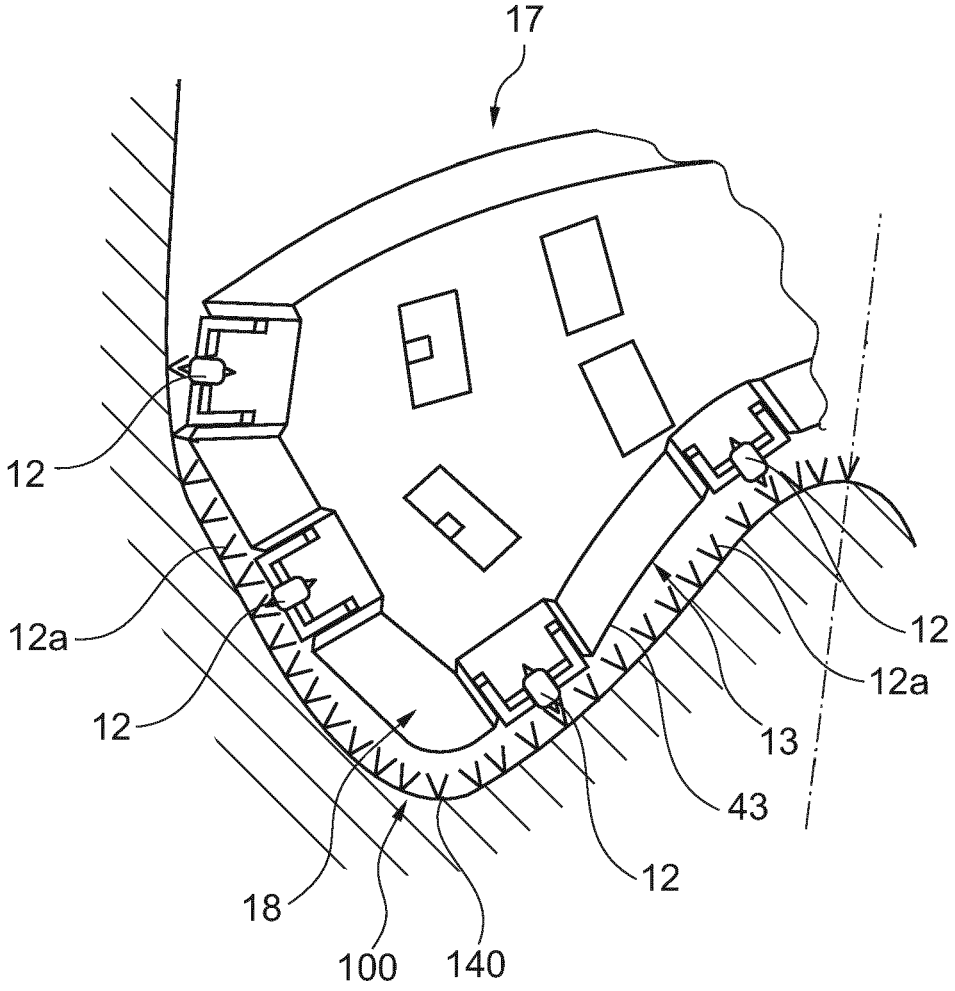
FIG. 5 shows a schematic three-dimensional partial view of FIG. 1.

FIG. 5 shows an arm 17 of the W-shaped drill head 10 according to FIG. 1 having drilling tools 12 as disks 12*a* disposed thereon, and having chisels on the lateral flanks 18 and on the flanks 43 on the lower side 13.

The drilling tools 12 disposed on the arms 17 are able to be replaced from the interior space of the arms 17.

Figure 6:
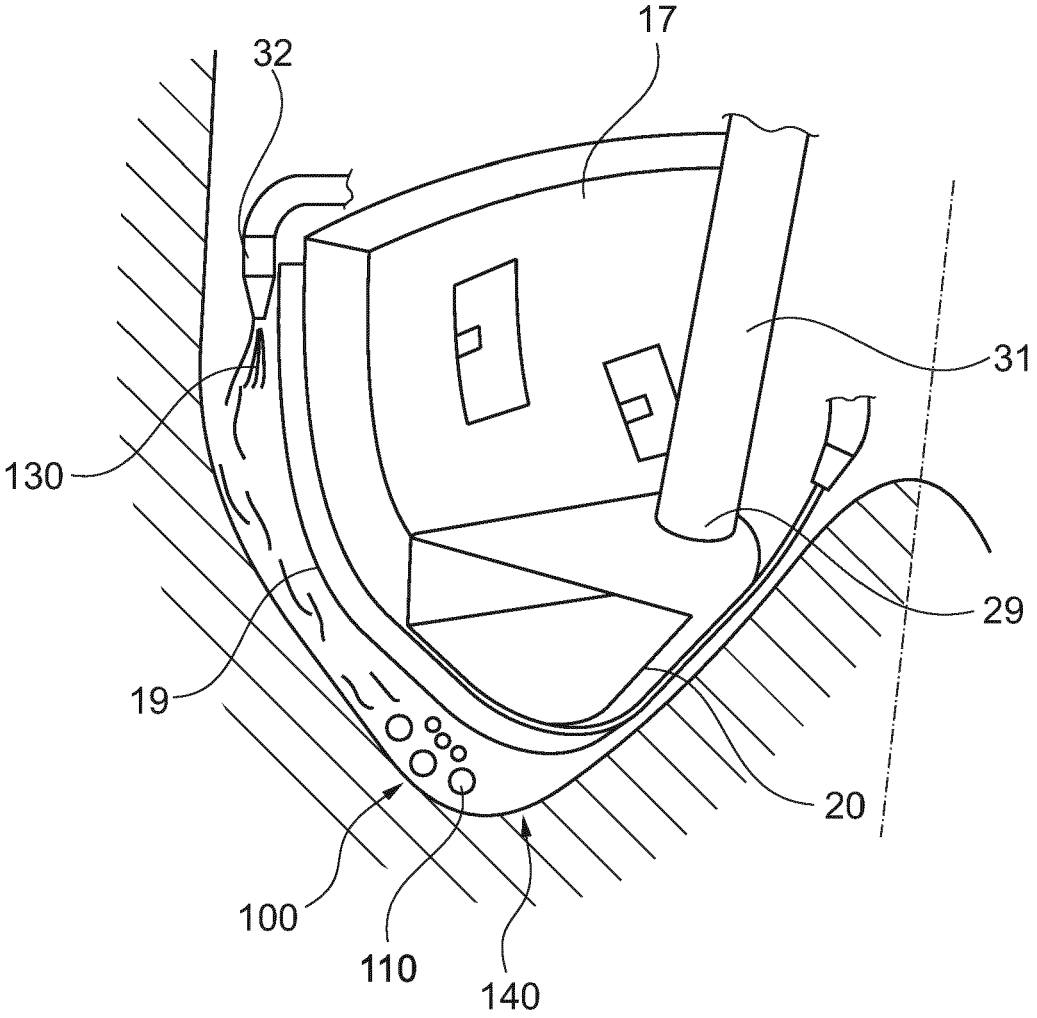
FIG. 6 shows a further schematic three-dimensional, partially sectional view of FIG. 1.
Figure 7:
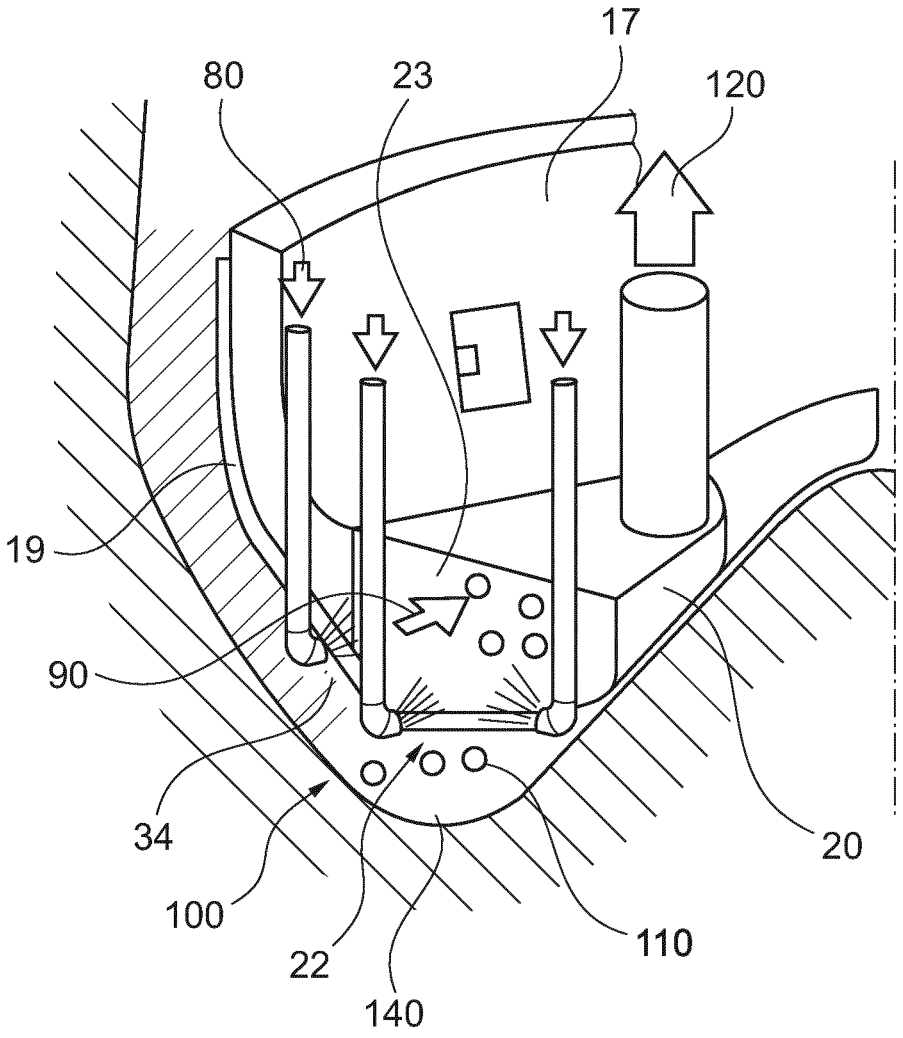
FIG. 7 shows a further schematic three-dimensional, partially sectional view of FIG. 1.

FIG. 6 shows an arm 17 of the W-shaped drill head 10 according to FIG. 1 having the suction box 20 and the conveying line 31 connected thereto, said suction box 20 and said conveying line 31 being provided within the arm 17. For the sake of simplicity, no drilling tools 12, 12*a* are illustrated in FIG. 6. Purging nozzles 32 which are aligned in the direction of the opening 23 of the suction box 20 are provided in the region of the clearing tool 19. Said purging nozzles 32 dispense a purging jet 130. The same medium as the transport medium can preferably be used here as the purging medium. The loosened debris 110 is transported by the purging jet 130 into the opening region 22, or toward the maximum penetration of the borehole 140, respectively. In this region, the loosened ground 110 is then fed to the opening 23 of the purging box 20 by the nozzles 34, as is shown in FIG. 7.

The sequence of loosening the ground and discharging the loosened ground, for example in conjunction with a drill head 10 as per FIG. 1, is shown in FIGS. 8 and 9. The ground here is loosened by drilling tools 12 and is situated in the region of the respective drilling tools. Purging nozzles 32 are preferably provided in the region of the respective drilling tools 12. Said purging nozzles 32 dispense a purging jet 130 which purges the loosened ground 110 into the region of the maximum penetration of the borehole 140. The suction box 20 by way of the opening 23 thereof is moved in this region. The transport medium jet 81, by way of which the loosened ground is accelerated into the opening 22 and for discharging thus moved into the purging box 20, and/or in the opening region 22 is suctioned directly by the suction box 20, is then dispensed by way of the nozzles 34 for dispensing the transport medium jet 81.

The movement/acceleration of the debris into the suction box 20 can be additionally supported by mechanical tools.

Figure 10:
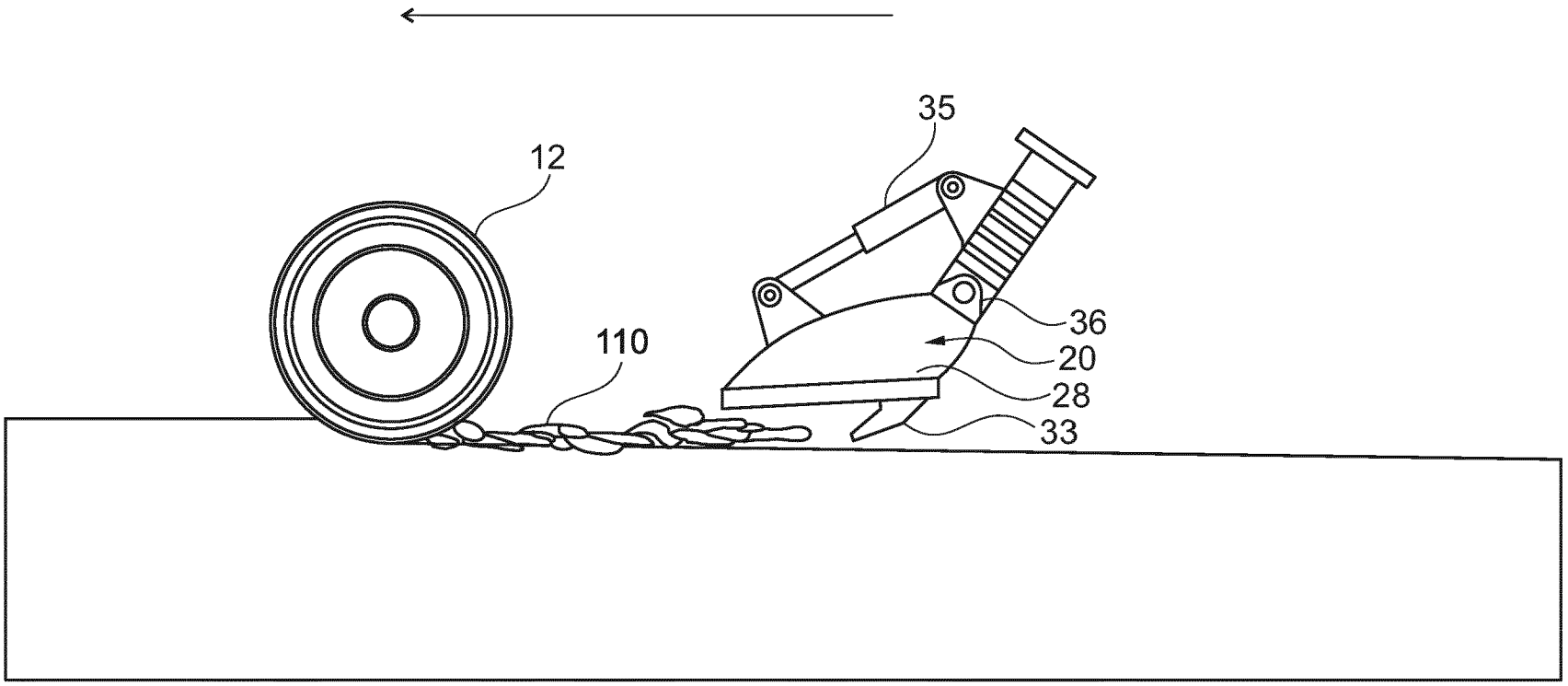
FIG. 10 shows a schematic lateral view of a first assembly of a suction box in a drill head according to the invention.

FIG. 10 shows the introduction of loosened ground into the suction box, the opening 29 thereof, or the connector 30 thereof to the conveying line 31, respectively, being provided behind the opening region 22. Shown is a mechanical support when picking up by means of a pick-up tool 33. The suction box 20 by way of a cylinder 35 can be pivoted about a pivot point 36. The nozzles 34 are not illustrated here.

Figure 11:
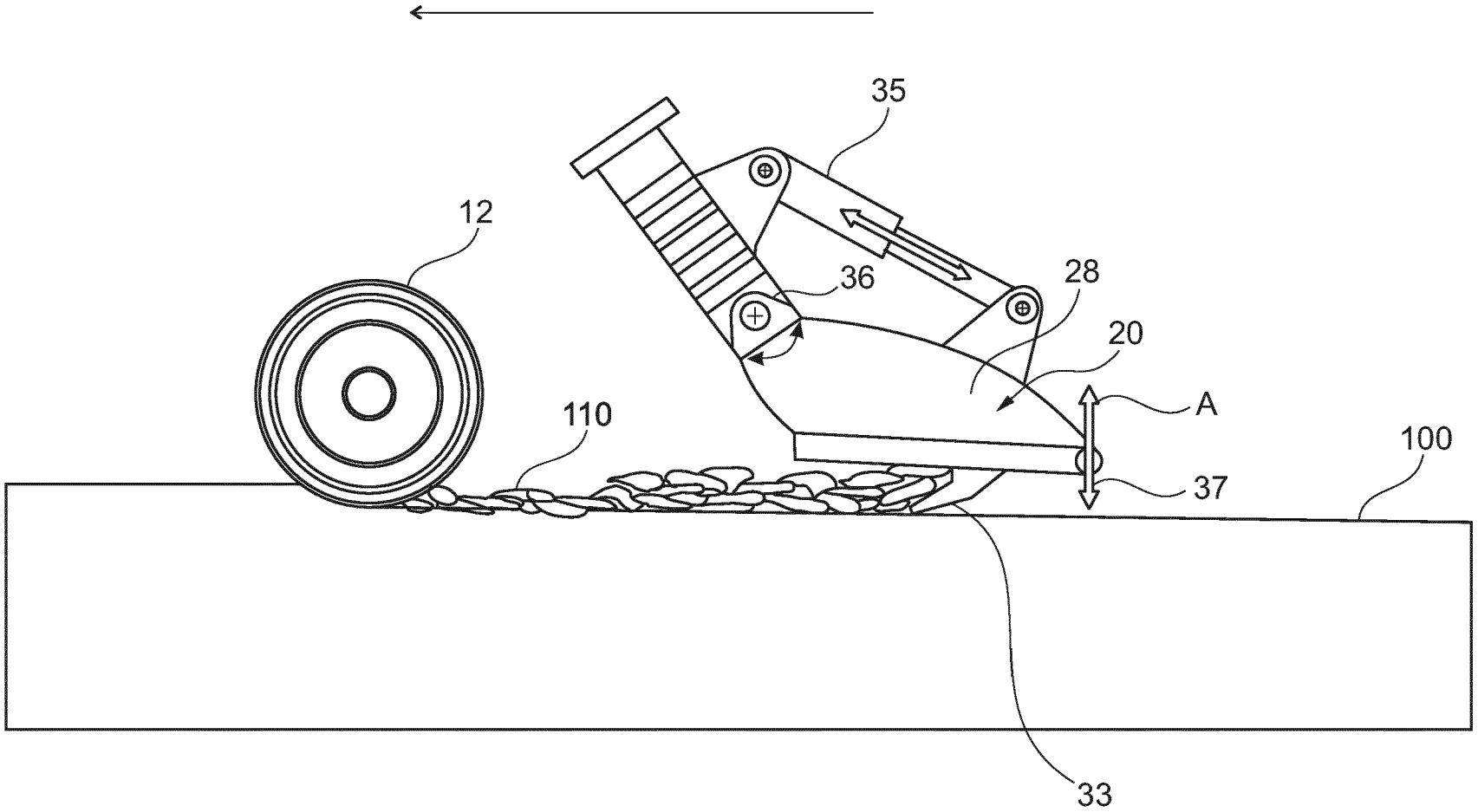
FIG. 11 shows a schematic lateral view of a second assembly of a suction box in a drill head according to the invention.
Figure 12:
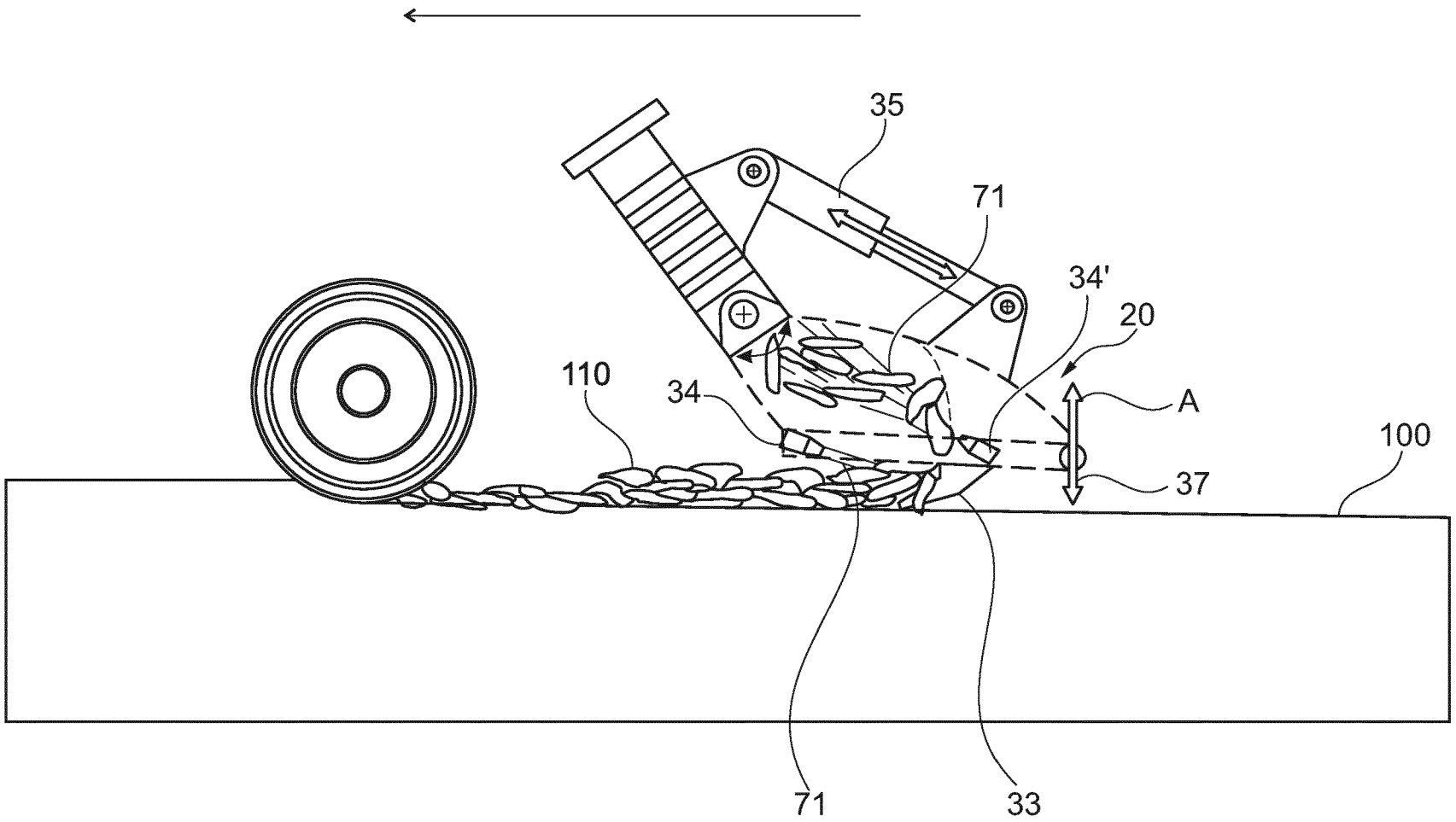
FIG. 12 shows a partially sectional view of FIG. 11.

FIGS. 11 and 12 show the introduction of loosened ground into the suction box 20, the opening 29 thereof, or the connector 30 thereof to the conveying line 31, respectively, being provided in front of the opening region 22. Shown is a mechanical support when picking up by means of a pick-up tool 33. The suction box 20 by way of a cylinder 35 can be pivoted about a pivot point 36. The suction box can thus be pivoted in the direction of the arrow A such that the spacing 37 from the face 100 is varied. The assembly of the nozzles 34 is shown in FIG. 12. Provided here is a first nozzle 34 which is directed in the direction of the deflection or pick-up tool 33. Furthermore provided is a second nozzle 34' which is directed in the direction of the opening 29 and the connector 30. The loosened ground 110 is fed to the conveying medium 120 and discharged conjointly with the latter by the two nozzles 34, 34'.

Figure 13:
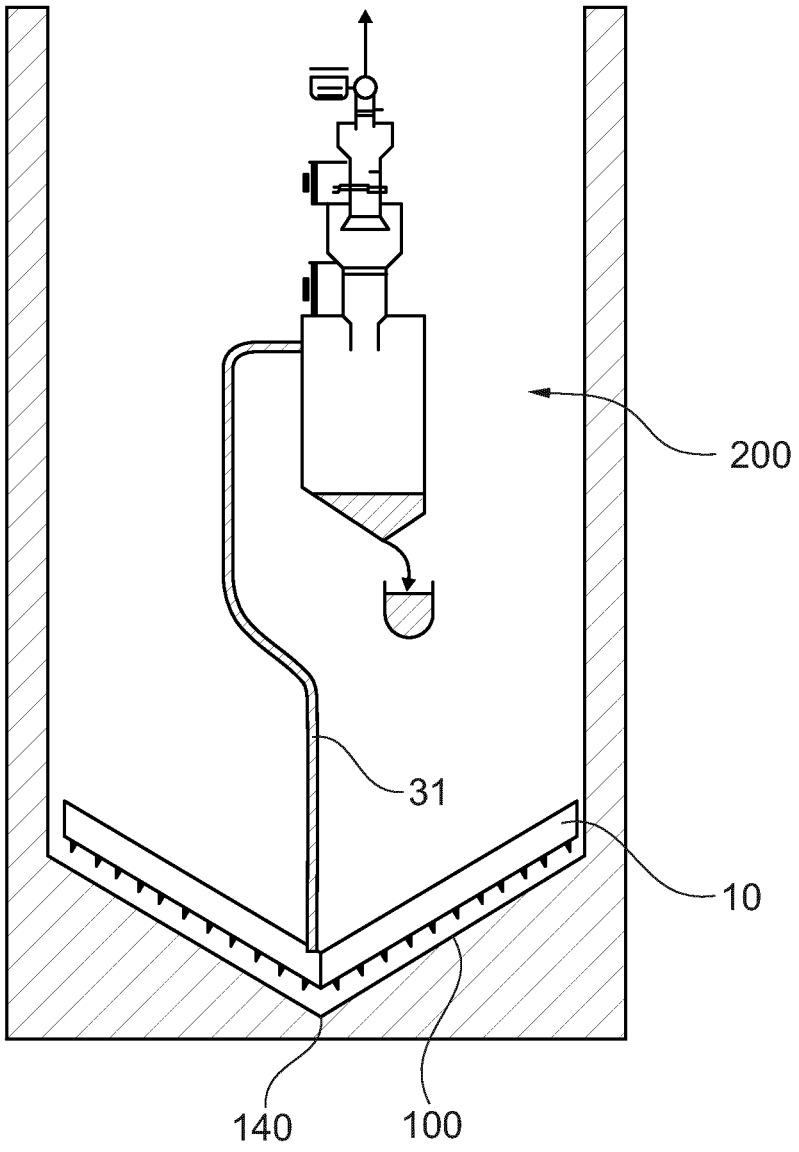
FIG. 13 shows a schematic lateral view of a treatment in a drill device having a drill head according to the invention.

The conveying flow discharged by way of the conveying line 31 is composed of a combination of solid component parts (loosened ground 110) as well as liquid and/or gaseous component parts. The latter are fed to a treatment 200 by way of the conveying line 31 (see FIG. 13). The component parts are separated from one another here, for example by means of at least one cyclone, liquid and/or dust separators. The gaseous component parts (air) are fed again to the drilling region (for example to the shaft already drilled). The liquid component parts are optionally fed to the nozzles 32, 34, 34' again, or discharged from the drilling region to surface. The solid component parts are by suitable means likewise discharged from the drilling region to the surface.

Figure 14:
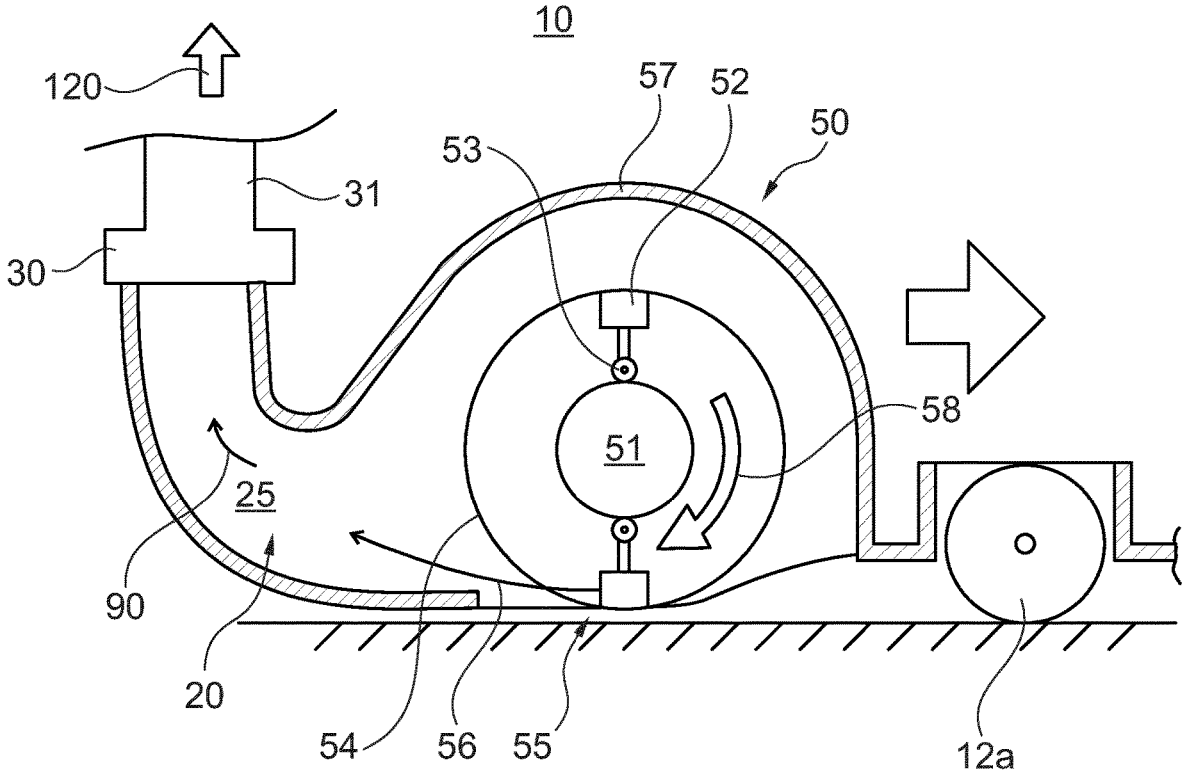
FIG. 14 shows a sectional view pertaining to a second embodiment of the invention.
Figure 15:
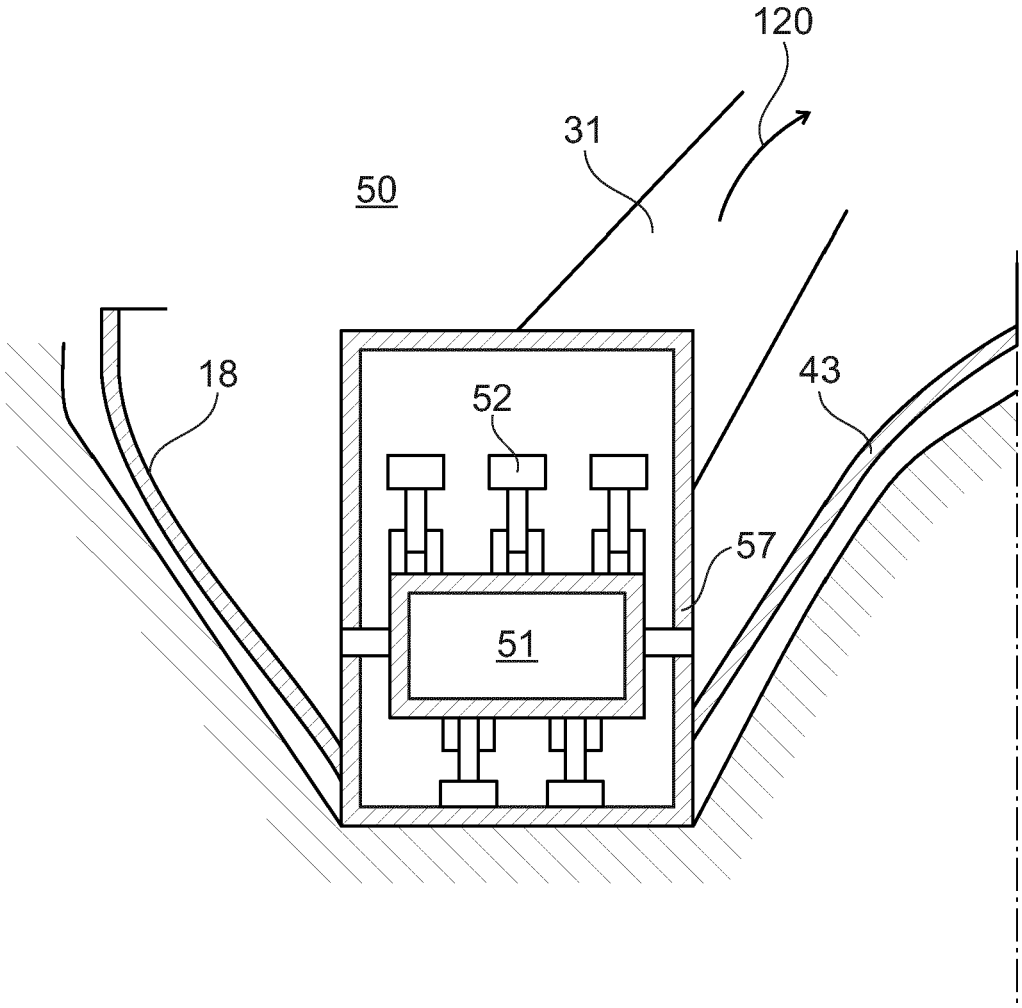
FIG. 15 shows a sectional view of FIG. 14 rotated by 90°.

Alternatively or additionally to introducing the acceleration into the loosened ground by means of nozzles and a transport medium, a second embodiment of the invention according to FIGS. 14 to 16 shows a mechanical introduction of acceleration. Provided to this end is an impact installation 50 which, while provided in the region of the suction box 20 so as to be toward the inside of the drill head 10, is able to perform an acceleration of the loosened ground 110 in the region of the face 100.

A rotary element 51 on which a plurality of impact elements 52 are provided in an encircling manner is disposed in a housing 57, said impact elements 52 here preferably being provided so as to be movable by way of a joint 53. The impact elements 52 move on an impact circle 54 which is provided so as to be concentric about the rotary element 51. The rotary element 51 is driven by way of a drive (not illustrated). Impact elements 52 impact loosened ground in an impact region 55, said loosened ground then being introduced in the impact direction 56 into the suction box 20, or into the opening 23 of the latter, respectively. In the interior space 25 there, and/or in the opening region 22, the accelerated loosened ground is then acquired by the conveying medium 90 and by way of the conveying flow 120 discharged through the conveying line 31.

FIG. 15 and FIG. 16 show different assembly widths of the impact installation 50 in conjunction with the flanks 18, 43 of the drill head 10.

It is advantageous here for the impact installation 50 to be embodied so as to be as wide as possible (at the bottom of FIG. 16) so as to achieve a better discharge output.

It is furthermore advantageous here for the flanks 18, 43, as shown at the top in FIG. 16, to be able to be embodied so as to be relatively steep and short in comparison to the installations in FIG. 15 and at the bottom in FIG. 16, such that flank purging, here in the form of an airflow or in the form of clearing elements (not illustrated), can even be dispensed with under certain circumstances.

| | |
|---|---|
| 10 | Drill head |
| 11 | Body |
| 12 | Drilling tool |
| 12a | Chisel disk |
| 12b | Peeling chisel |
| 12c | Roller chisel |
| 13 | Lower side |
| 14 | Upper side |
| 15 | Annular portion |
| 16 | Lower side |
| 17 | Arm |
| 18 | Flank |
| 19 | Clearing tool |
| 20 | Suction box |
| 21 | Front side |
| 22 | Opening region |
| 23 | Opening |
| 23a | Opening portion |
| 24 | Classifying element |
| 25 | Interior space |
| 26 | Lid |
| 27 | Ground |
| 28 | Side wall |
| 29 | Opening |
| 30 | Connector |
| 31 | Conveying line |
| 32 | Purging nozzle |
| 33 | Ground loosening tool/ground pick-up tool |
| 34/34' | Nozzle |
| 35 | Cylinder |
| 36 | Pivot point |
| 37 | Spacing |
| 40 | Consumable element |
| 41 | Depression |
| 42 | Area |
| 43 | Flank |
| 45 | Connector |
| 50 | Impact installation |
| 51 | Rotary element |
| 52 | Impact element |
| 53 | Joint |
| 54 | Impact circle |
| 55 | Impact region |
| 56 | Impact direction |
| 57 | Housing |
| 58 | Direction of rotation |
| 80 | Transport medium |
| 81 | Transport medium jet |
| 90 | Conveying medium |
| 100 | Face |
| 110 | Loosened ground |
| 120 | Conveying flow |

-continued

| | |
|---|---|
| 130 | Purging jet |
| 140 | Maximum penetration of the borehole |
| 200 | Treatment |

The invention claimed is:

1. A drill head for producing a vertical borehole in the ground comprising:

a body connectable to a rotary drive of a drilling device, drilling tools disposed on the body for loosening the ground at a face of the borehole;

a discharge device connectable to a suction unit of the drilling device configured to discharge the loosened ground on the face wherein the suction unit is configured to suction a conveying medium via a conveying line of the drilling device, wherein the discharge device comprises an opening disposed on the body; the opening disposed adjacent the drilling tools at the face;

a suction box disposed in the discharge device connected to the at least one opening, the suction box comprising a connector opening opposite the opening, the connector opening connectable to the suction line;

at least one acceleration element exerting an acceleration on the loosened ground to move the ground loosened by the drilling tools one of toward the opening;

wherein the loosened ground is picked up by the conveying medium and is discharged via the conveying line by the suction unit;

wherein a spacing of the opening in relation to the face is adjustable; and wherein the adjustment of the spacing is provided one of by vertically moving the suction box relative to the body of the drill head with an actuator or by pivoting the suction box about a pivot point relative to the body of the drill head with an actuator.

2. The drill head as claimed in claim 1, wherein the at least one acceleration element comprises at least one nozzle directed toward the opening dispensing at least one jet of a transport medium.

3. The drill head as claimed in claim 1, wherein at least one flushing nozzle is configured for transporting ground loosened to a region on the face traversed by the suction box as the drill head rotates.

4. The drill head as claimed in claim 1, wherein the suction box comprises at least one nozzle in an interior space of the suction box.

5. The drill head as claimed in claim 1, wherein one of the conveying medium or the transport medium is one of a liquid or gaseous medium.

6. The drill head as claimed in claim 5, wherein the liquid is one of water or a bentonite suspension.

7. The drill head as claimed in claim 5, wherein the gaseous medium is air.

8. The drill head as claimed in claim 1, wherein the at least one acceleration element is at least one driven rotary element comprising at least one impact element, wherein the at least one impact element is rotated.

9. The drill head as claimed in claim 8, wherein the impact element is rotated on an impact circle concentric about the rotary element.

10. The drill head as claimed in claim 8, wherein the at least one impact element is movably disposed on the at least one rotary element.

11. The drill head as claimed in claim 8, wherein the at least one impact element comprises at least one of a hammer, a blade, a cable, a chain, a brush element, or a chisel.

12. The drill head as claimed in claim 8, wherein the rotation speed of the at least one rotary element is controllable.

13. The drill head as claimed in claim 1, wherein the suction box is disposed in one of a horizontal, inclined or vertical orientation.

14. The drill head as claimed in claim 1, further comprising at least one tool for one of loosening ground or picking up loosened ground.

15. The drill head as claimed in claim 14, wherein the at least one tool is moveable to change the spacing between the tool and the face.

16. The drill head as claimed in claim 14, wherein the at least one tool is pivotable.

17. The drill head as claimed in claim 14, wherein the at least one tool is a toothed bar.

18. The drill head as claimed in claim 1, wherein at least one deflection region for changing the direction of the flow of loosened ground is provided between the opening and the suction box.

19. The drill head as claimed in claim 1, wherein the opening has an elongate extent.

* * * * *